US006491493B1

(12) United States Patent
Watanabe et al.

(10) Patent No.: US 6,491,493 B1
(45) Date of Patent: Dec. 10, 2002

(54) TURBINE NOZZLE VANE

(75) Inventors: Hiroyoshi Watanabe, Kanagawa (JP); Hideomi Harada, Kanagawa (JP)

(73) Assignee: EBARA Corporation, Tokyo (JP)

( * ) Notice: Subject to any disclaimer, the term of this patent is extended or adjusted under 35 U.S.C. 154(b) by 0 days.

(21) Appl. No.: 09/719,398

(22) PCT Filed: Jun. 10, 1999

(86) PCT No.: PCT/JP99/03101

§ 371 (c)(1),
(2), (4) Date: Feb. 1, 2001

(87) PCT Pub. No.: WO99/64725

PCT Pub. Date: Dec. 16, 1999

(30) Foreign Application Priority Data

Jun. 12, 1998 (JP) ..... 10-164833

(51) Int. Cl.[7] ..... F01D 5/14
(52) U.S. Cl. ..... 415/191; 415/210.1
(58) Field of Search ..... 415/191, 192, 415/208.1, 208.2, 209.1, 209.4, 210.1

(56) References Cited

U.S. PATENT DOCUMENTS

| | | | | | |
|---|---|---|---|---|---|
| 2,801,790 | A | * | 8/1957 | Doll, Jr. | 415/210.1 |
| 4,704,066 | A | * | 11/1987 | Weissbacher | 415/191 |
| 5,906,474 | A | * | 5/1999 | Haller et al. | 415/191 |
| 5,947,683 | A | * | 9/1999 | Kobayashi | 415/208.1 |

FOREIGN PATENT DOCUMENTS

| | | | | |
|---|---|---|---|---|
| EP | 0661 413 | | 7/1997 | |
| EP | 0 833 060 | | 4/1998 | |
| FR | 2.053.049 | | 4/1971 | |
| GB | 200269 | * | 7/1923 | 415/208.1 |
| JP | 58-128403 | | 8/1983 | |
| JP | 1-106903 | | 4/1989 | |
| JP | 229205 A | * | 8/1994 | 415/208.1 |
| JP | 10-61405 | | 3/1998 | |
| JP | 10-77801 | | 3/1998 | |
| JP | 10-131707 | | 5/1998 | |
| JP | 10-196303 | | 7/1998 | |

OTHER PUBLICATIONS

M. Jansen et al.; "Modern Blade Design for Improving Steam Turbine Efficiency," VDI Cerichte NR, 1185, 1998, p. 277–290.

* cited by examiner

*Primary Examiner*—John E. Ryznic
(74) *Attorney, Agent, or Firm*—Armstrong, Westerman & Hattori, LLP

(57) ABSTRACT

A turbine nozzle comprises an array of nozzle blades (1) U disposed circumferentially in an annular passage (4) defined between inner and outer rings of a diaphragm and fixed to the inner and outer rings of the turbine diaphragm. The flow passage is defined between a pressure surface (F) and a suction surface (B) of adjacent ones of the nozzle blades, and a cross section of the flow passage includes predetermined ranges extending along a blade height (h) from the inner and outer diameter surfaces (hub and tip end walls) and defined by a curved line, and another range defined by a substantially straight line.

6 Claims, 10 Drawing Sheets

TURBINE NOZZLE VANE

TECHNICAL FIELD

The present invention relates to a turbine nozzle, and more particularly to a turbine nozzle having an array of nozzle blades disposed circumferentially in an annular passage defined between an inner ring and an outer ring of a diaphragm and fixed to the inner and outer rings of the diaphragm.

BACKGROUND ART

It has been recognized in recent years that it is important to improve the performance of a turbine in order to improve energy consumption for mechanical operation or improve the efficiency of power generation in a power generating plant.

In order to improve the performance of a turbine, it is necessary to reduce the internal losses in each of the turbine stages. The internal losses in each of the turbine stages include a blade profile loss, a secondary flow loss, and a leakage loss.

The proportion of the secondary flow loss is large in a turbine stage where an aspect ratio (blade height/blade chord) is small and a blade height is small. Therefore, it is effective to reduce the secondary flow loss for thereby improving the performance of the turbine.

The mechanism of generation of the secondary flow will be described below.

As shown in FIG. 15 of the accompanying drawings, a flow G flowing in between nozzle blades 1 is subject to a force caused by a pressure gradient from a pressure surface F to a suction surface B in each of the nozzle blades 1. In a main flow-away from a turbine end wall, the force caused by the pressure gradient and a centrifugal force caused by the turning of the flow are in balance. However, a flow in a boundary layer near the turbine end wall has a low level of kinetic energy, and hence is carried from the pressure surface F to the suction surface B by the force caused by the pressure gradient as indicated by the arrows J. In a latter half of the flow passage, the flow collides with the suction surface B and rolls up, thus forming a flow passage vortex W. The flow passage vortex W accumulates a low-energy fluid in the end wall boundary layer to thereby generate a non-uniform energy distribution downstream of the nozzle blade. Although the non-uniform energy distribution is uniformized downstream of the nozzle blade, a large energy loss is generated during its uniformization. In FIG. 15, E represents a radial line, and L represents a hub end wall.

Various attempts have heretofore been made to suppress the above secondary flow.

For example, as shown in FIG, 16 of the accompanying drawings, bales 1 are inclined at an angle θ to the radial line E for thereby weakening any blade-to-blade pressure gradient near the hub end wall of the blade. In FIG. 16, reference numeral 2 represents an outer ring, and reference numeral 3 represents an inner ring. Further, as shown in FIGS. 17 and 18 of the accompanying drawings, nozzle blades 1 are curved at their opposite ends to orient the pressure surfaces F to the end wall. In FIG. 17, U represents an outer diameter surface. In FIG. 18, θt represents the angle between the tangent to the blade stacking line 1 at the tip end wall and radial line E, θr represents the angle between the tangent to the blade stacking line 1 at the hub end wall and radial line E, and h represents a blade height. According to the conventional attempts, while the same blade profile is employed, blade stacking lines are cured or inclined in a direction to weaken the blade-to-blade pressure gradient near the end walls, thereby controlling the secondary flow to reduce the loss.

Another conventional technology involves an inclined or curved surface imparted to a nozzle blade across its entire height for thereby controlling the secondary flow, as disclosed in Japanese laid-open patent publication No. 10-77801.

In order to control the pressure gradient with the above conventional arrangements, the nozzle blade needs to be largely inclined or curved, and hence efforts to meet such a requirement tend to cause problems in the manufacturing process or in the mechanical strength of the nozzle blades.

Further, according to such curved or inclined blades, a flow distribution at the outlet of the blades is liable to differ greatly from a flow distribution on blades which are neither curved nor inclined.

For example, FIG. 19 of the accompanying drawings shows a graph having a horizontal axis representative of positions along the height of a blade, which are expressed as a dimensionless ratio with respect to the height h, and a vertical axis representative of circumferential velocities Vt and meridional velocities Vm, which are expressed as a dimensionless ratio with respect to the absolute velocity V ($=(Vt^2+Vm^2)^{0.5}$). The graph shown in FIG. 19 indicates that flow velocity distributions of an ordinary blade (indicated by the solid-line curves) and those of a curved blade (indicated by the broken-line curves) differ at the opposite ends of the blades.

If nozzle blades are of a curved shape and are combined with conventional rotor blades positioned downstream of the nozzle blades, then flows from the nozzle blades do not match the rotor blades, and the curved nozzle blades may not be effective. In such a case, new rotor blades capable of matching flows from the outlet of the curved nozzle blades are required, and thus such an arrangement cannot meet a wide range of applications.

DISCLOSURE OF INVENTION

It is therefore an object of the present invention to provide a turbine nozzle which is capable of reducing a secondary flow loss and producing an outlet flow that is the same as an outlet flow from ordinary blades, and does not adversely affect rotor blades positioned downstream of the turbine nozzle.

According to one aspect of the present invention, there is provided a turbine nozzle comprising: an array of nozzle blades (1) disposed circumferentially in an annular passage (4) defined between inner and outer rings of a diaphragm and fixed to the inner and outer rings of the diaphragm; and a flow passage defined between a pressure surface (F) and a suction surface (B) of adjacent ones of the nozzle blades, a cross section of the flow passage including predetermined ranges extending along a blade height from the inner and outer diameter surfaces (hub and tip end walls) and defined by a curved line, and another range defined by a substantially straight line.

Since the cross section of the flow passage in the predetermined ranges on the pressure surface and the suction surface includes a region defined by the curved line and a region defined by the substantially straight line, the turbine nozzle according to the present invention is clearly different in structure from the nozzle blade disclosed in Japanese laid-open patent publication No. 10-77801.

According to another aspect of the present invention, there is also provided a turbine nozzle comprising: an array of nozzle blades (1) disposed circumferentially in an annular passage (4) defined between inner and outer rings of a diaphragm and fixed to the inner and outer rings of the diaphragm; a pressure surface (F) in each of the nozzle blades facing the tip end wall of the turbine diaphragm in a predetermined range in the meridional direction of the nozzle blade and in a predetermined range between the tip end wall and a midspan of a blade, and the pressure surface facing the hub end wall of the turbine diaphragm in a predetermined range between the hub end wall and the midspan of the blade; a suction surface (B) in each of the nozzle blades facing the hub end wall of the turbine diaphragm in a predetermined range in the meridional direction of the nozzle blade and in a predetermined range between the tip end wall and a midspan of the blade, and the suction surface facing the tip end wall of the diaphragm in a predetermined range between the hub end wall and the midspan of said blade.

Here, the predetermined range may comprise a range corresponding to at least 30% of a meridional width (Cx) of the nozzle blade from a leading edge (1*f*) of the nozzle blade in a meridional direction (x). The predetermined range may comprise a range corresponding to 20 to 40% of the blade height (h) from the hub end wall (L) of the nozzle blade (1), and a range corresponding to 20 to 40% of the blade height (h) from the tip end wall (U) of the nozzle blade (1).

In the above predetermined ranges, the pressure surface (F) of the nozzle blade (1) is arranged to face the tip end wall at the tip end wall side, i.e., is curved to face the tip end wall, and is arranged to face the hub end wall at the hub end wall side, i.e., is curved to face the hub end wall, and the suction surface (B) of the nozzle blade (1) is arranged to face the hub end wall at the tip end wall side, i.e., is curved to face the hub end wall, and is arranged to face the tip end wall at the hub end wall side, i.e., is curved to face the tip end wall.

A line (1*p*) on the pressure surface and a line (1*s*) on the suction surface along the height of the nozzle blade (1) have central portions (S) which are preferably defined by substantially straight lines except for the range (C1) corresponding to 20 to 40% from the hub end wall (L) along the height (h) of the nozzle blade (1) and the range (C2) corresponding to 20 to 40% from the tip end wall (U) along the height (h) of the nozzle blade (1). Specifically, a line on the pressure surface (F) and a line on the suction surface (B) in the cross section of the flow passage in an arbitrary meridional position in a range of at least 30% from a leading edge (1*f*) of the nozzle blade along a meridional width (Cx) of the nozzle blade have central portions which are preferably defined by substantially straight lines except for the range (C1) corresponding to 20 to 40% from the hub end wall (L) along the height (h) of the nozzle blade (1) and the range (C2) corresponding to 20 to 40% from the tip end wall (U) along the height (h) of the nozzle blade (1).

The cross section of the flow passage is defined by a line on said pressure surface (F) and a line on said suction surface (B) in a meridional position within a range of at least 30% from a leading edge (1*f*) of the nozzle blade (1) along a meridional width (Cx) of the nozzle blade (1), each of the lines comprising a substantially straight line in a central region of the nozzle blade.

The distance (Sh) from an intersection (Pt1) between the line (C1) on the pressure surface or the suction surface and the hub end wall (L) to an intersection (Pc1) between an extension (SE1) of the central portion (S) on the pressure surface or the suction surface defined by the substantially straight line and the hub end wall (L), and the distance (St) from an intersection (Pt2) between the line (C2) on the pressure surface or the suction surface and the tip end wall (U) to an intersection (Pc2) between an extension (SE2) of the central portion (S) and the tip end wall (U) have a maximum value at the leading edge (1*f*) of the nozzle blade, and at least 4% of the blade height (h) in a position at 30% of the meridional width from the leading edge of the nozzle blade.

The maximum value of the distances (Sh, St) at the leading edge (1*f*) of the nozzle blade (1) should be preferably in the range of from 5 to 15% of the blade height (h).

If the distance between the intersections from the leading edge (1*f*) of the nozzle blade to a position at 55–65% of the meridional width is represented by Sh or St, the nozzle height is represented by h, and the ratio of the meridional distance from the leading edge (1*f*) of the nozzle blade to the blade width (Cx) is represented by Λ, then the following equation should preferably be satisfied:

$$St/h,\ Sh/h=\Sigma An\cdot\Lambda^{n}$$

where An represents a coefficient and n is an integer of 0 or greater.

In the above equation, a higher-order term which is substantially zero is negligible. In other words, n is an integer of 0 or greater which is of a numerical value including all higher-order terms that are not negligibly small.

The above and other objects, features, and advantages of the present invention will become apparent from the following description when taken in conjunction with the accompanying drawings which illustrate a preferred embodiment of the present invention by way of example.

BEST MODE FOR CARRYING OUT THE INVENTION

A turbine nozzle according to an embodiment of the present invention will be described with reference to drawings.

Figure 1:
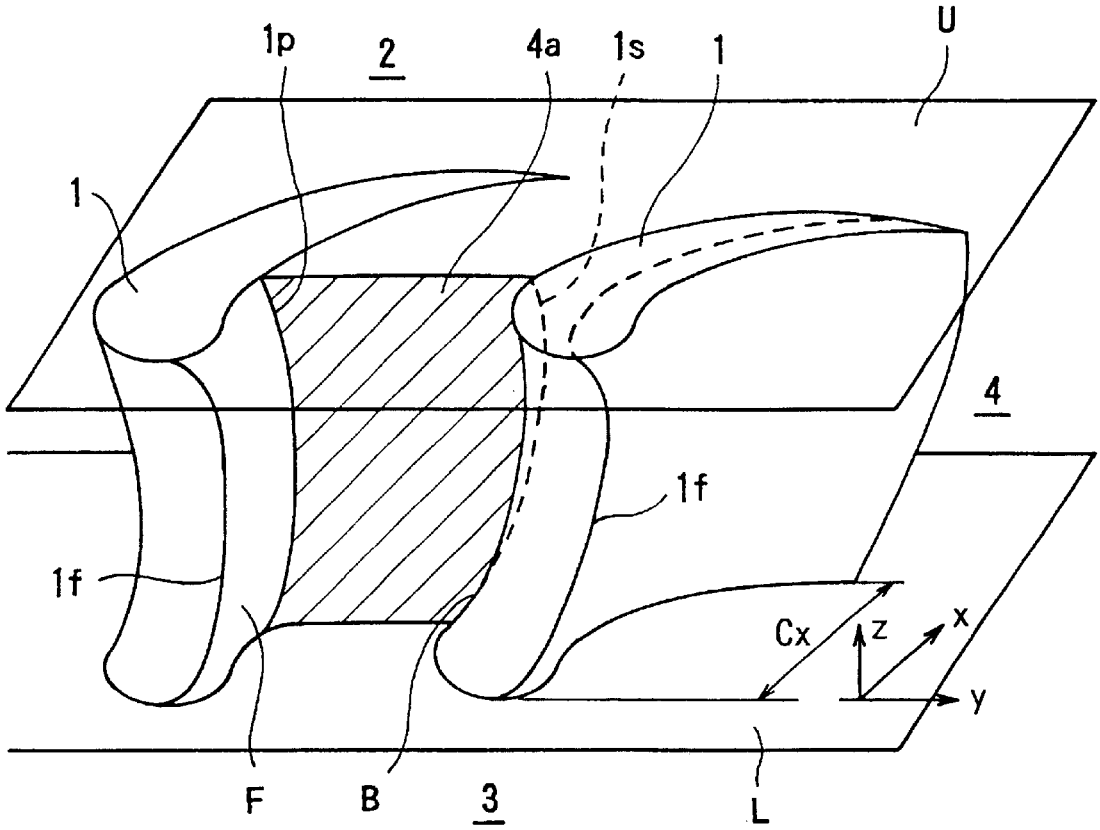
FIG. 1 is a perspective view of a turbine nozzle according to an embodiment of the present invention.

As shown in FIG. 1, a turbine nozzle according to the present invention comprises an array of nozzle blades 1 in a circumferential direction (y) in an annular passage 4 defined between an inner ring 3 and an outer ring 2 of a diaphragm. The nozzle blades 1 have hub and tip end walls L, U on their opposite ends which are fixed respectively to an outer diameter surface (tip end wall) of the inner ring 3 and an inner diameter surface (hub end wall) of the outer ring 2. The turbine nozzle is shown in perspective in FIG. 1 and viewed from a position upstream of the turbine nozzle. Each of the nozzle blades 1 has a blade profile section or an aerofoil section, and has a pressure surface F and a suction surface B.

A flow passage defined between the pressure surface F and the suction surface B of adjacent ones of the nozzle blades 1 has a cross section 4*a* in an arbitrary meridional position. The cross section 4*a* has a lateral edge defined by a line 1*p* on the pressure surface F and an opposite lateral edge defined by a line is on the suction surface B. Each nozzle blade 1 has a width Cx in its meridional direction (x). In FIG. 1, z represents radial direction.

On each nozzle blade 1, in a region from a leading edge 1*f* to a position of at least 30% of the width Cx in the meridional direction (x), and in ranges Lh, Lt (see FIG. 2) corresponding to 20 to 40% of a blade height h inwardly from the hub and tip end walls L, U (i.e. in a direction from the hub end wall L toward the tip end wall U and in a direction from the tip end wall U toward the hub end wall L), the line 1*p* on the pressure surface F and the line 1*s* on the suction surface B which form the cross section 4*a* are composed of straight or curved lines C1, C2 facing the hub end wall L and the tip end wall U, respectively. Other portions of the lines 1*p*, 1*s* than the ranges Lh, Lt, i.e., central portions of the lines 1*p*, 1*s*, are composed of a straight line S.

Figure 2:
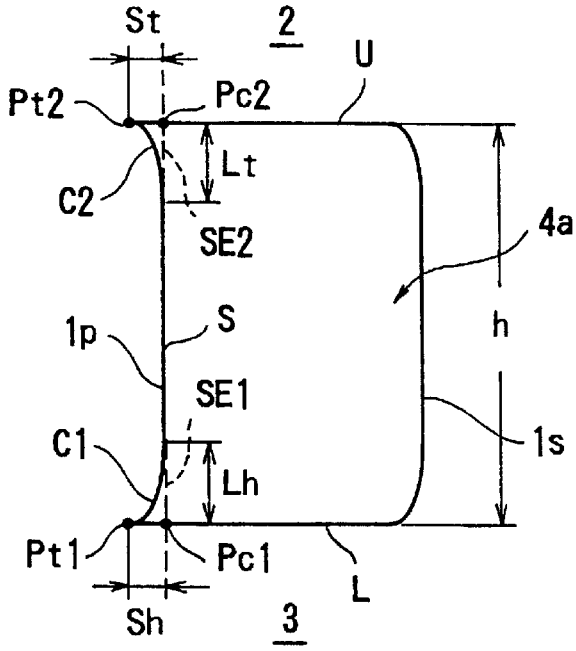
FIG. 2 is a cross-sectional view of a flow passage in the turbine nozzle shown in FIG. 1.

Therefore, as shown in FIG. 2, in the flow passage 4*a* between the pressure surface F and the suction surface B of adjacent nozzle blades 1, the ranges Lh, Lt corresponding to 20 to 40% of the blade height h inwardly from the hub and tip end walls L, U are defined by the straight or curved line C (C1, C2: parabola in the illustrated embodiment) inclined from the pressure surface F to the suction surface B toward the ends L, U.

The displacements from the straight portion S on the hub and tip end walls L, U, i.e., the distance Sh from an intersection Pt1 between the inclined line C1 and the hub end wall L to an intersection Pc1 between an extension SE1 (indicated by a dotted line in FIG. 2) of the straight portion S and the hub end wall L, and the distance St from an intersection Pt2 between the inclined line C2 and the tip end wall U to an intersection Pc2 between an extension SE2 (indicated by a dotted line in FIG. 2) of the straight portion S and the outer diameter surface U, have a maximum value at the leading edge 1*f* of the nozzle blade, and are progressively decreased toward the trailing edge of the nozzle blade.

The effect of the meridional range in which the inclined portions C1, C2 are added will be described below.

Figure 3:
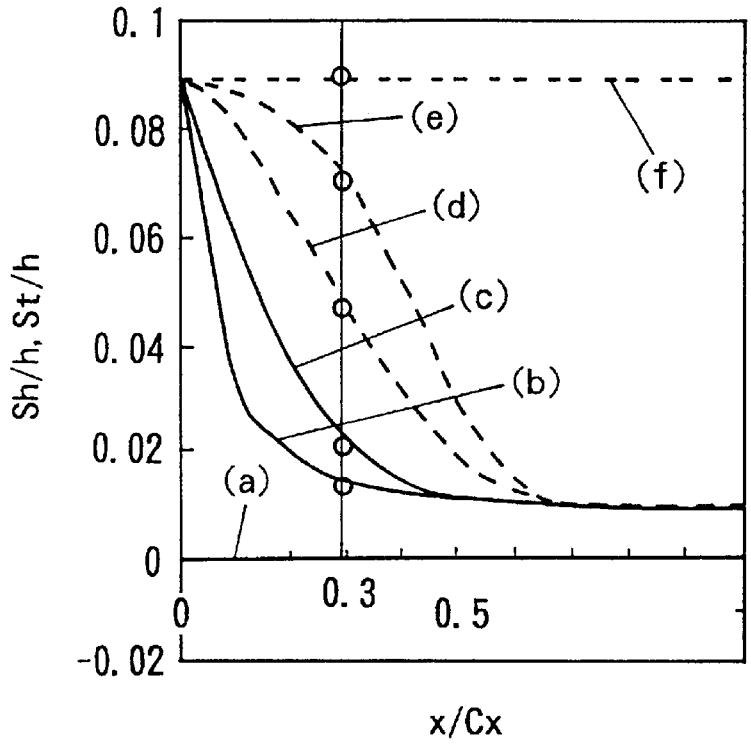
FIG. 3 is a diagram showing a meridional distribution of distances Sh, St of nozzle blades according to the present invention.
Figures 4A, 4B, 4C, 4D:
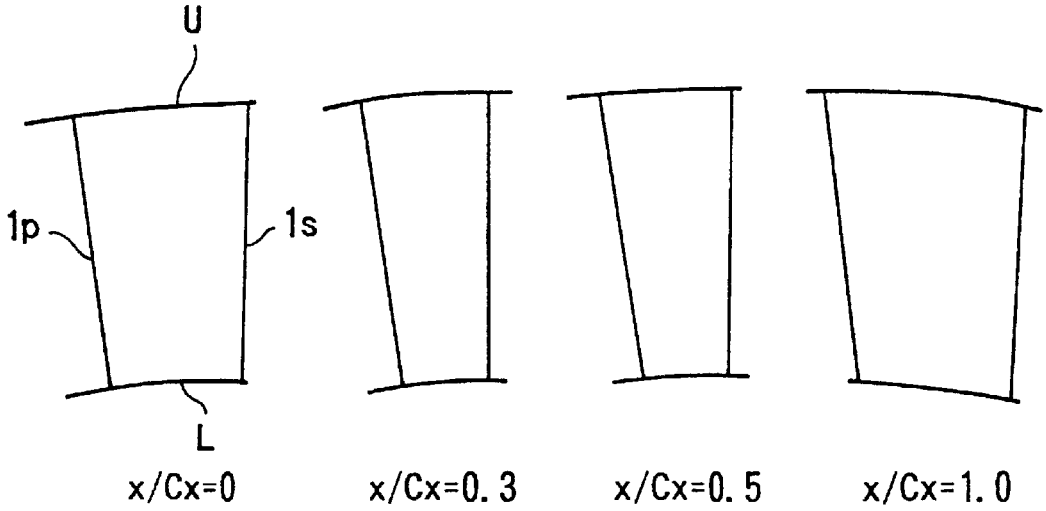
FIGS. 4A through 4D are diagrams showing how the cross section of a flow passage changes in the meridional direction of nozzle blades of a conventional turbine nozzle.
Figures 5A, 5B, 5C, 5D:
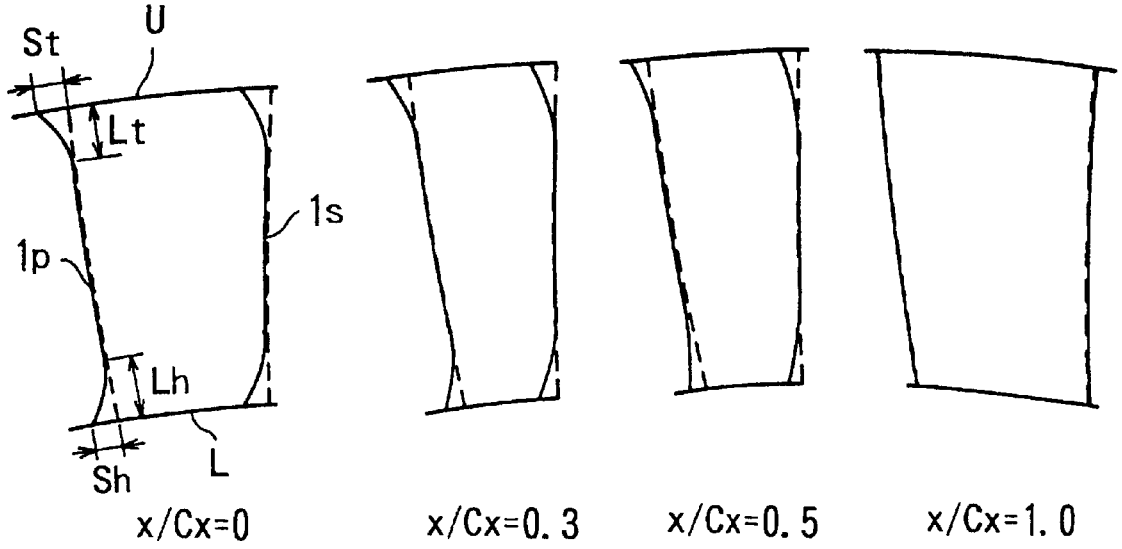
FIGS. 5A through 5D are diagrams showing how the cross section of a flow passage changes in the meridional direction of nozzle blades of the turbine nozzle according to the embodiment of the present invention.

In FIG. 3, various examples in changes in the distances St, Sh to the meridional direction (x) are shown by characteristic curves (a), (b), (c), (d), (e) and (f). In FIG. 3, the horizontal axis represents x/Cx, and the vertical axis represents Sh/h, St/h. Here, x/Cx is defined as meridional distance from the leading edge nondimensionalyzed by blade meridional width Cx. In the examples shown by these characteristic curves (a)–(f), the ratio of the distance Sh (=St) to the blade height h at the leading edge 1*f* is selected to be Sh/h=0.09 except for the example shown by the characteristic curve (a). The ratios of the ranges Lh, Lt to the blade height h are selected to be Lh/h=Lt/h =0.25.

With respect to the characteristic curve (a), the distances Sh, St are Sh=0, St=0 within the entire nozzle blade, thus representing the conventional nozzle blade profile.

Changes in the cross section of the flow passage in the meridional direction with respect to the conventional nozzle blade (represented by the characteristic curve (a)) are shown in FIGS. 4A through 4D. Changes in the cross section of the flow passage in the meridional direction with respect to an inventive nozzle blade (represented by the characteristic curve (e)) are shown in FIGS. 5A through 5D.

Figure 6:
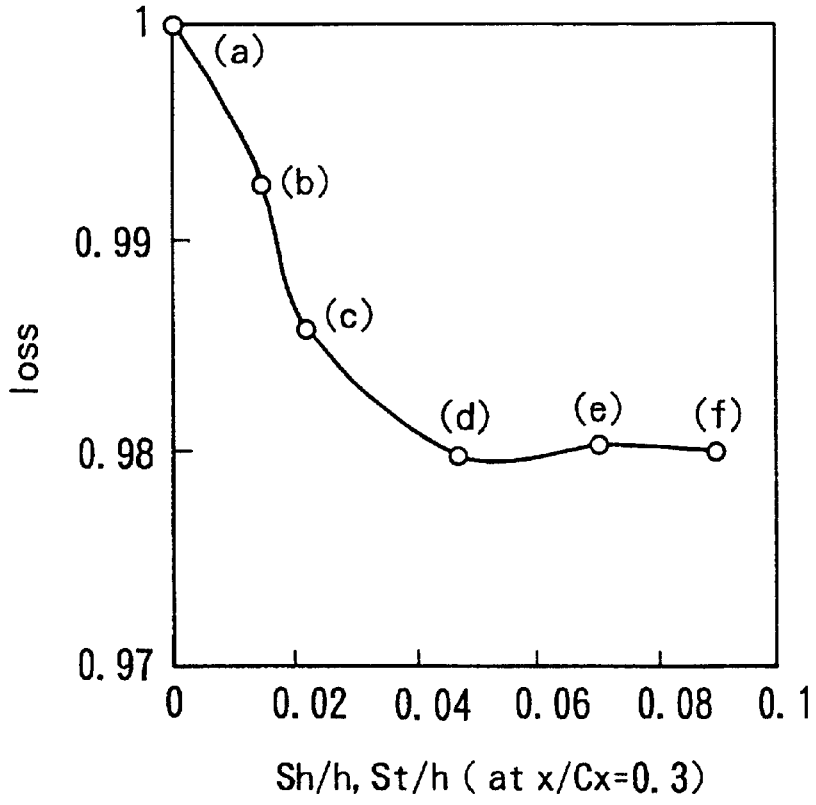
FIG. 6 is a graph showing the relationship between distances Sh, St at x/Cx=0.3 and loss.

FIG. 6 shows, for comparison, total pressure losses, calculated by a viscous flow analysis, of the nozzle blades represented by the characteristic curves (a)–(f), with respect to the distance Sh at the meridional distance x/Cx=0.3.

A study of FIG. 6 indicates that as the distance Sh at x/Cx=0.3 increases, the loss decreases up to Sh/h=0.046, and remains substantially unchanged for the characteristic curves (d), (e) and (f) of Sh/h>0.046.

If consideration is given to simplicity or ease in manufacture, then the nozzle blades where the distance Sh decreases to substantially zero at x/Cx=0.6 as shown in FIG. 3, as indicated by the characteristic curves (d), (e), are preferable to the nozzle blade where the distance Sh is constant over the entirety of the longitudinal width and the inclined portions C1, C2 are present over the entirety of the meridional width, as indicated by the characteristic curve (f), because the flow passage has a simpler configuration.

The effect of the ranges Lh, Lt in the blade height in which the inclined portions C1, C2 are added will be described below.

Figure 7:
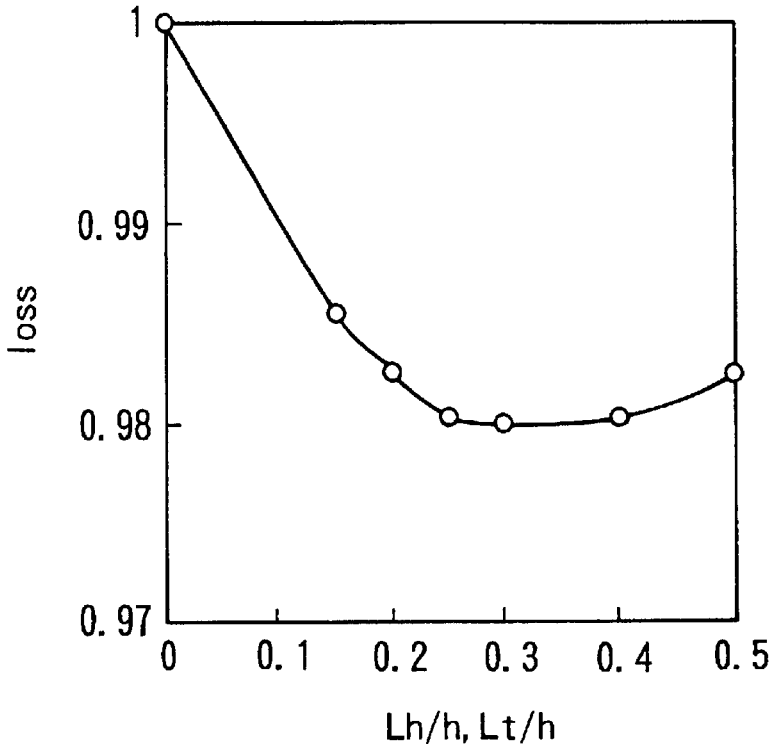
FIG. 7 is a graph showing the relationship between heights Lh, Lt and loss.

FIG. 7 shows the effect of the ranges Lh, Lt in the blade height, in which the inclined portions C1, C2 are added, on the loss, with respect to the nozzle blades where the distribution of the distances Sh, St decreases to substantially zero at x/Cx=0.6 and Sh/h is equal to 0.09 at the leading edge of the nozzle blade, as represented by the characteristic curves (b), (c), (d), (e) in FIG. 3.

It can be understood from FIG. 7 that the nozzle blades according to the present invention suffer smaller losses than the conventional nozzle blade regardless of the magnitudes of the ranges Lh, Lt, and particularly the loss is minimum in the ranges of 0.2<Lh/h, Lt/h<0.4.

The effect of the distances Sh, St at the leading edge of the nozzle blade will be described below.

Figure 8:
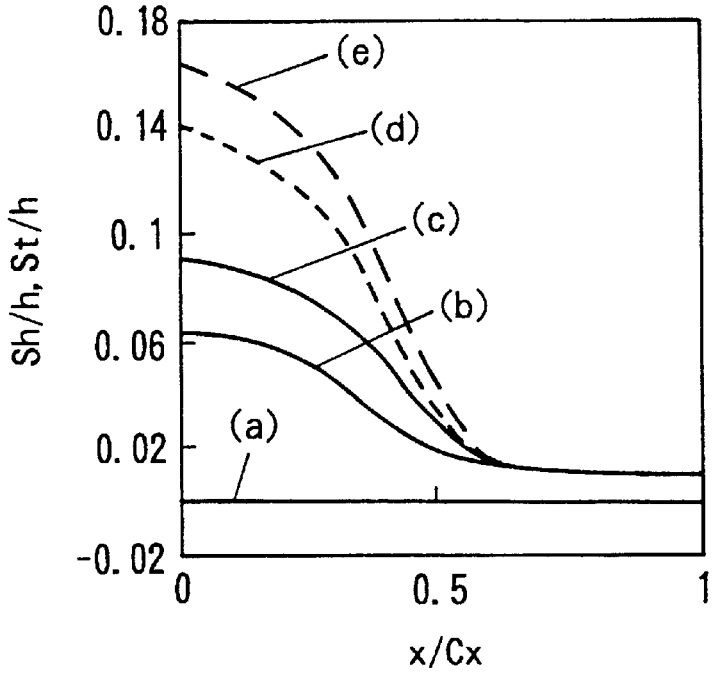
FIG. 8 is a diagram showing a meridional distribution of distances Sh, St of nozzle blades according to the embodiment of the present invention.
Figure 9:
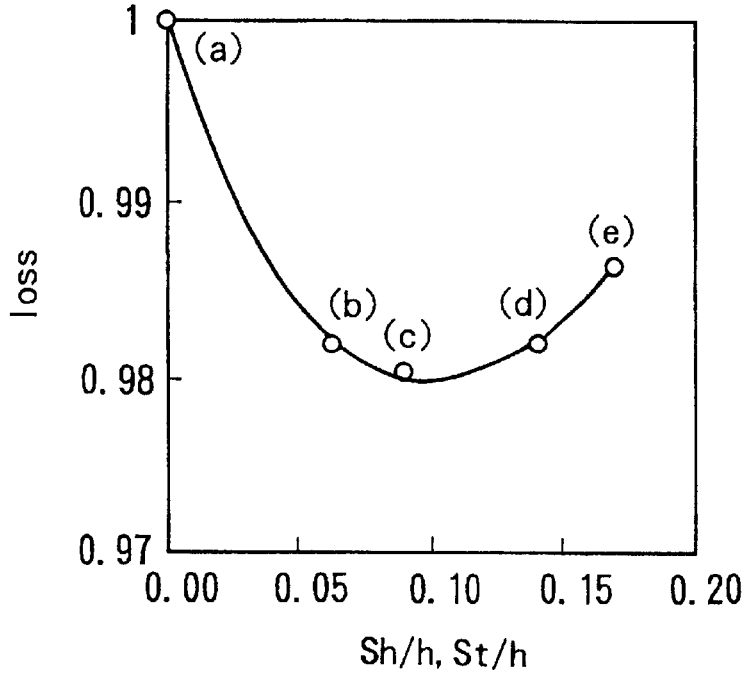
FIG. 9 is a graph showing the relationship between the distances Sh, St at the leading edge and loss.

FIG. 8 shows the nozzle blades represented by the characteristic curves (a)–(e) and having different distances Sh, St at the leading edge thereof, and FIG. 9 shows total pressure losses, calculated by a viscous flow analysis, of those nozzle blades. The horizontal axis of FIG. 9 indicates Sh/h (=St/h) at the inlet of the nozzle blade.

As can be seen from FIG. 8, the distribution of the distances Sh, St in the maridional direction of each of the nozzle blades represented by the characteristic curves (b)–(e) decreases to substantially zero at x/Cx=0.6.

As can be seen from FIG. 9, the nozzle blades represented by the characteristic curves (b)–(e) where Sh/h is up to about 0.16 at the leading edge thereof suffer smaller losses than the conventional nozzle blade. The nozzle blades represented by the characteristic curves (b)–(d) are preferable because the loss is minimum particularly in the ranges of 0.05<Sh/h<0.15.

FIGS. 10 through 13 show detailed results of analytical calculations on the conventional ordinary nozzle blade and the nozzle blade according to the present invention.

Figure 10:
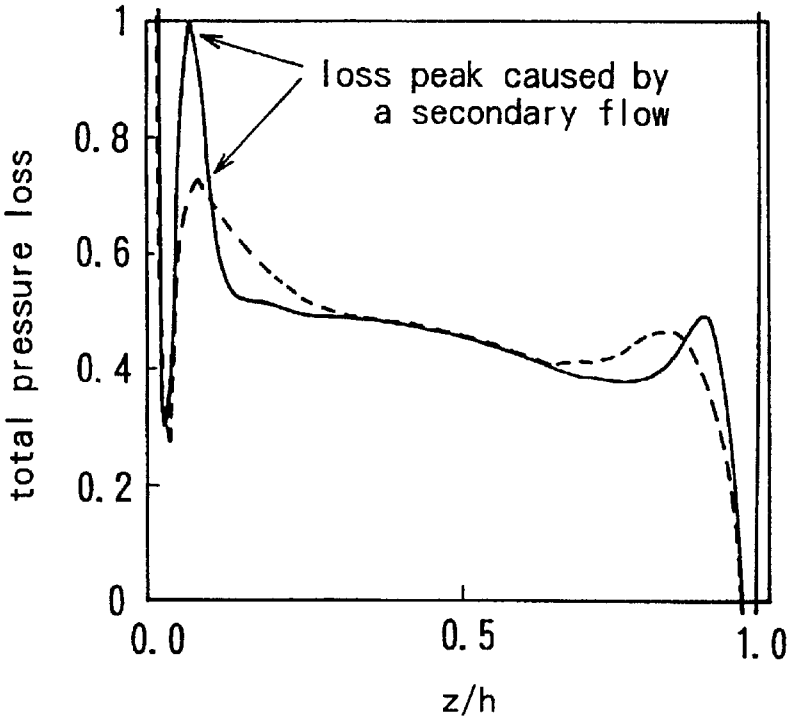
FIG. 10 is a graph showing loss distributions at outlet of the conventional blade and the blade according to the present invention for comparison.

FIG. 10 shows, for comparison, loss distributions, calculated by a viscous flow analysis, at the cross sections of blade outlets of the conventional nozzle blade and the nozzle blade according to the present invention where Sh/h=0.09, St/h=0.106, Lh/h=Lt/h=0.25 at the leading edge and the distribution of the distances Sh, St in the meridional direction decreases to substantially zero at x/Cx=0.6. In FIG. 10, the horizontal axis represents z/h, and the vertical axis represents the total pressure loss.

It can be understood from FIG. 10 that in the ordinary nozzle blade (indicated by a solid-line curve), a loss peak caused by a secondary flow is present near the hub and tip end walls, resulting in non-uniform flows which cause a large loss when they are mixed and diffused downstream of the blade, and that in the inventive nozzle blade (indicated by a broken-line curve), a loss peak caused by a secondary flow near the hub end wall is about 30% lower than the ordinary nozzle blade.

Figure 11:
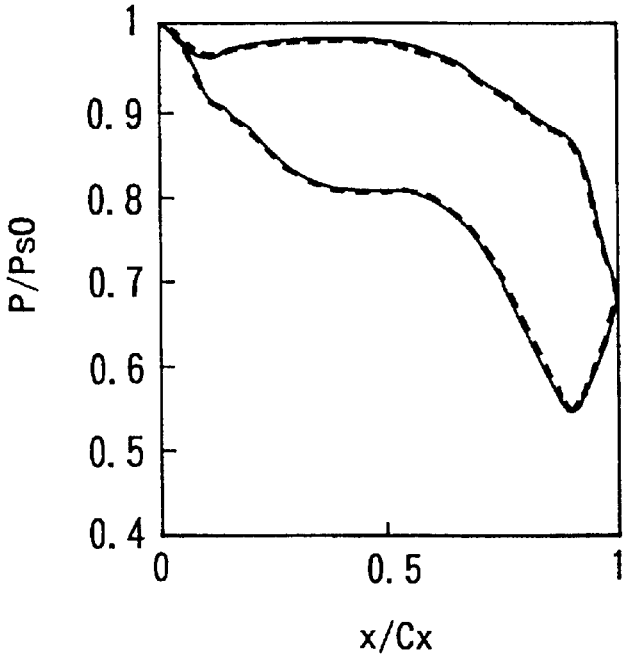
FIG. 11 is a graph showing a distribution of static pressures on a blade surface at the midspan of the blade.
Figure 12:
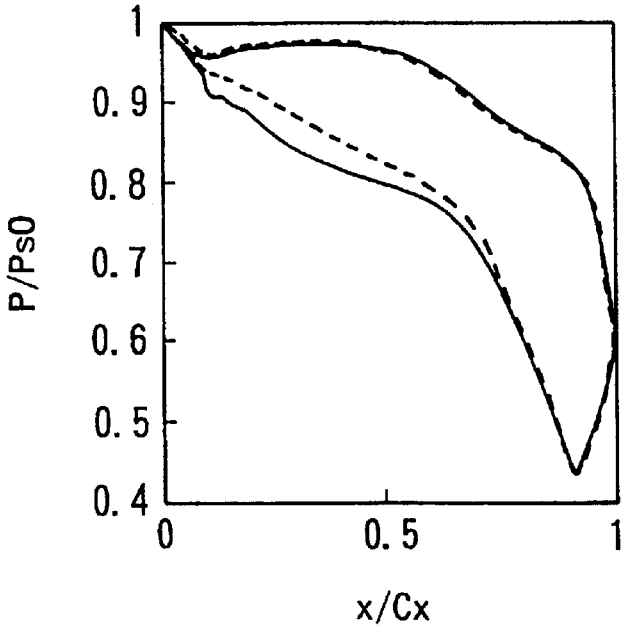
FIG. 12 is a graph showing a distribution of static pressures on a blade surface at a hub end wall of a turbine diaphragm.

FIG. 11 shows a distribution of static pressures on a blade surface at the midspan of the blade, and FIG. 12 shows a distribution of static pressures on a blade surface at the hub end wall of the turbine diaphragm. In FIGS. 11 and 12, the horizontal axis represents x/Cx, and the vertical axis represents P/PsO (surface pressure nondimensionalyzed by static pressure at the nozzle inlet). It can be seen from FIGS. 11 and 12 that the static pressures on the inventive blade (indicated by the broken-line curve) and the ordinary blade (indicated by the solid-line curve) are the same at the midspan of the blade, but the blade loading (pressure difference between the pressure surface and the suction surface) of the inventive blade on the hub end wall is smaller at the blade inlet side.

Such a change in the loading distribution of the blade, i.e., the fact that the blade loading of the inventive blade is smaller at the blade inlet side than that of the conventional blade, will be described below in terms of a change in the static pressure distribution in the cross section 4*a* of the flow passage in the nozzle.

Figure 14A:
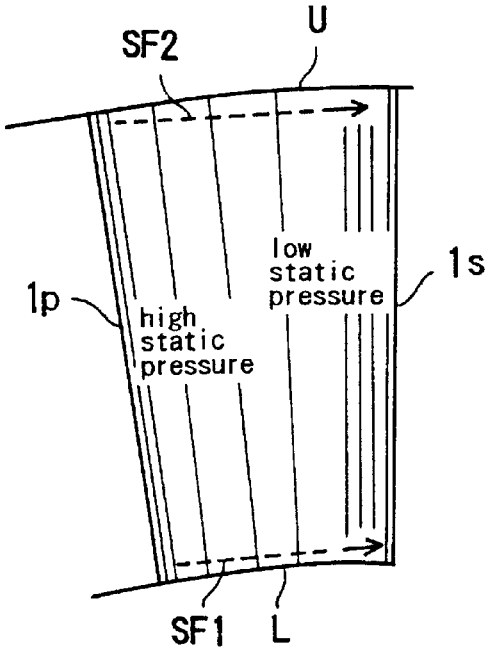
FIGS. 14A and 14B are diagrams showing distributions of contour lines of static pressures in the cross section of a flow passage on a conventional nozzle blade and the nozzle blade according to the present invention for comparison, respectively.
Figure 14B:
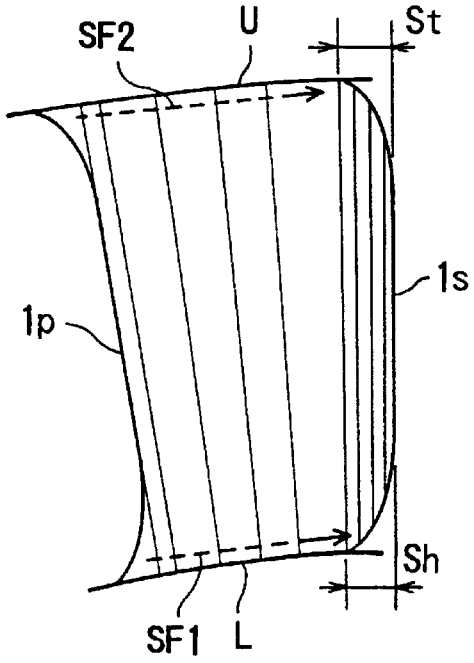
Figure 15:
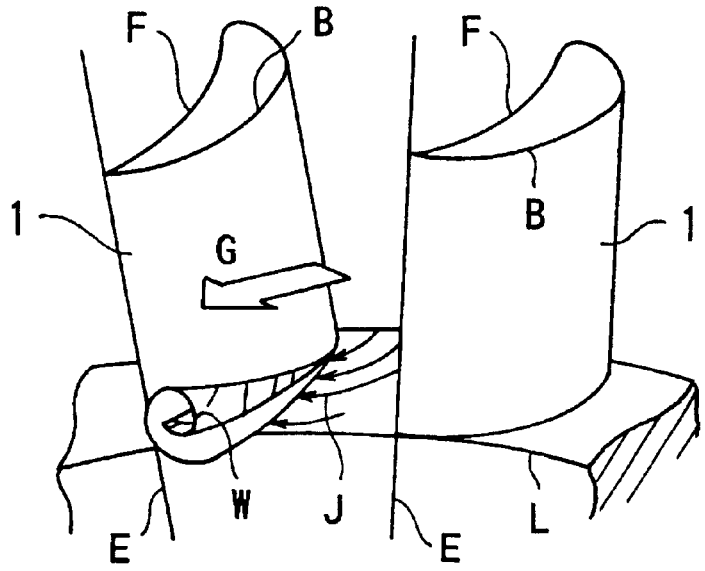
FIG. 15 is a fragmentary perspective view illustrative of a flow in a conventional turbine nozzle.
Figure 16:
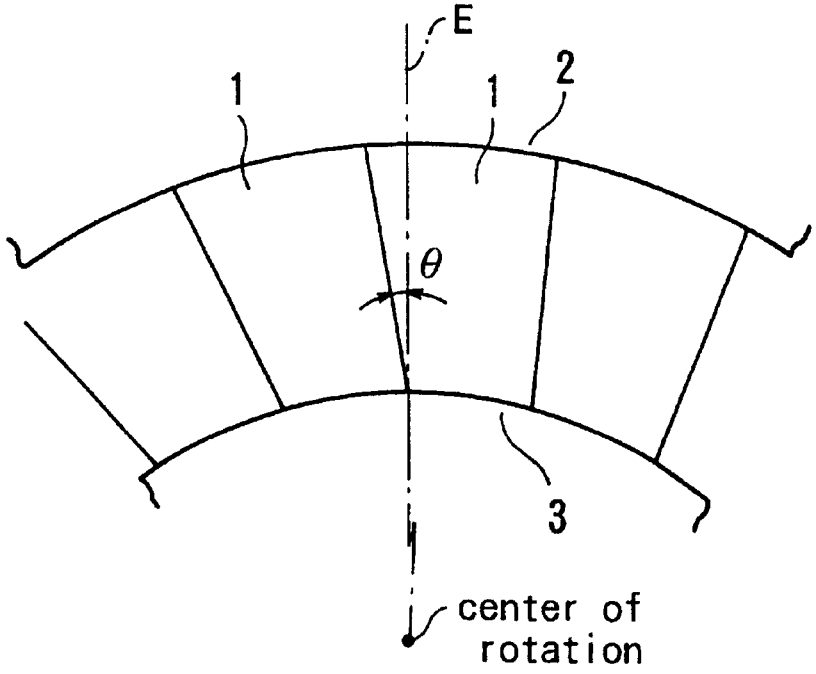
FIG. 16 is a fragmentary front elevational view of a conventional nozzle having inclined blades for reducing a secondary flow loss.
Figure 17:
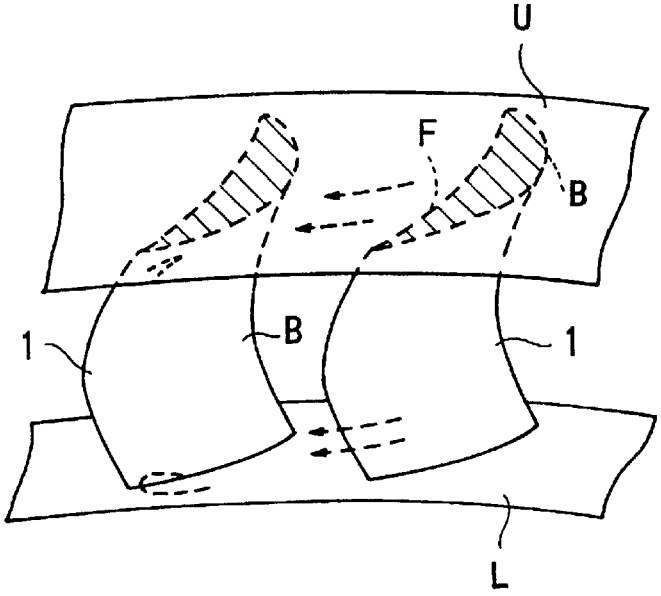
FIG. 17 is a fragmentary perspective view of a conventional nozzle having curved blades for reducing a secondary flow loss.
Figure 18:
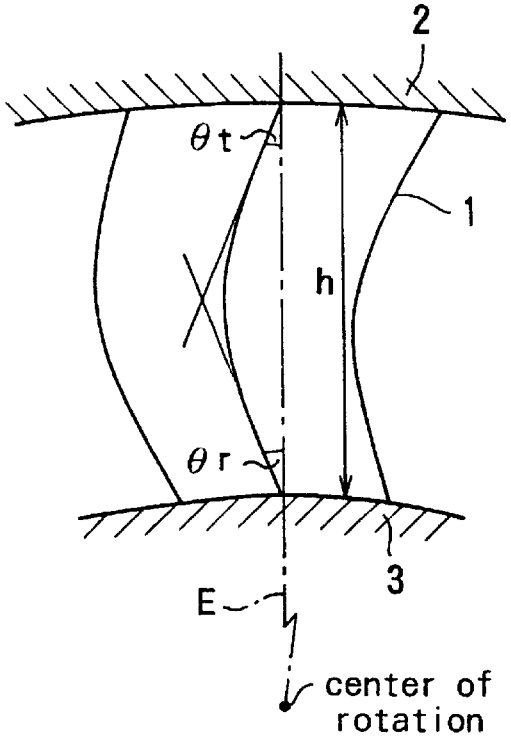
FIG. 18 is a fragmentary front elevational view of the nozzle shown in FIG. 17.

Contour lines of static pressures in the cross section 4*a* of the flow passage in the conventional nozzle blade and the inventive nozzle blade are shown in FIGS. 14A and 14B. In the conventional nozzle blade, the contour lines of the static pressures are distributed in substantially parallel with the line 1*p* on the pressure surface F and the line 1*s* on the suction surface B. In the vicinity of the line is on the suction surface B, the static pressure at the center of the blade height and the static pressures on the hub and tip end walls L, U are substantially the same.

In the inventive nozzle blade, the distribution of static pressures across the blade height near the line is on the suction surface B is greater by Sh, St than that at the center of the blade height (the region of the straight portion S shown in FIG. 2) in the vicinity of the hub end wall L and the tip end wall U. Therefore, the blade loading decreases because the static pressure near the line 1*s* on the suction surface B increases in the vicinity of the hub end wall L and the tip end wall U.

In FIGS. 14A and 14B, the broken-line arrows SF1, SF2 indicate secondary flows near the both end walls directed from the line 1*p* on the pressure surface F to the line 1*s* on the suction surface B in the cross section 4*a* of the flow passage.

The secondary flows SF1, SF2 are produced by the pressure difference (the blade loading) between the pressure surface F and the suction surface B in the vicinity of the hub end wall L and the tip end wall U, and the intensity of the secondary flows SF1, SF2 is proportional to the magnitude of the blade loading. Therefore, in the inventive nozzle blade that is capable of making the blade loading smaller in the vicinity of the hub end wall L and the tip end wall U than the conventional nozzle blade, the secondary flow is more suppressed than on the conventional nozzle blade, and hence the loss caused by the secondary flow can be reduced.

Figure 19:
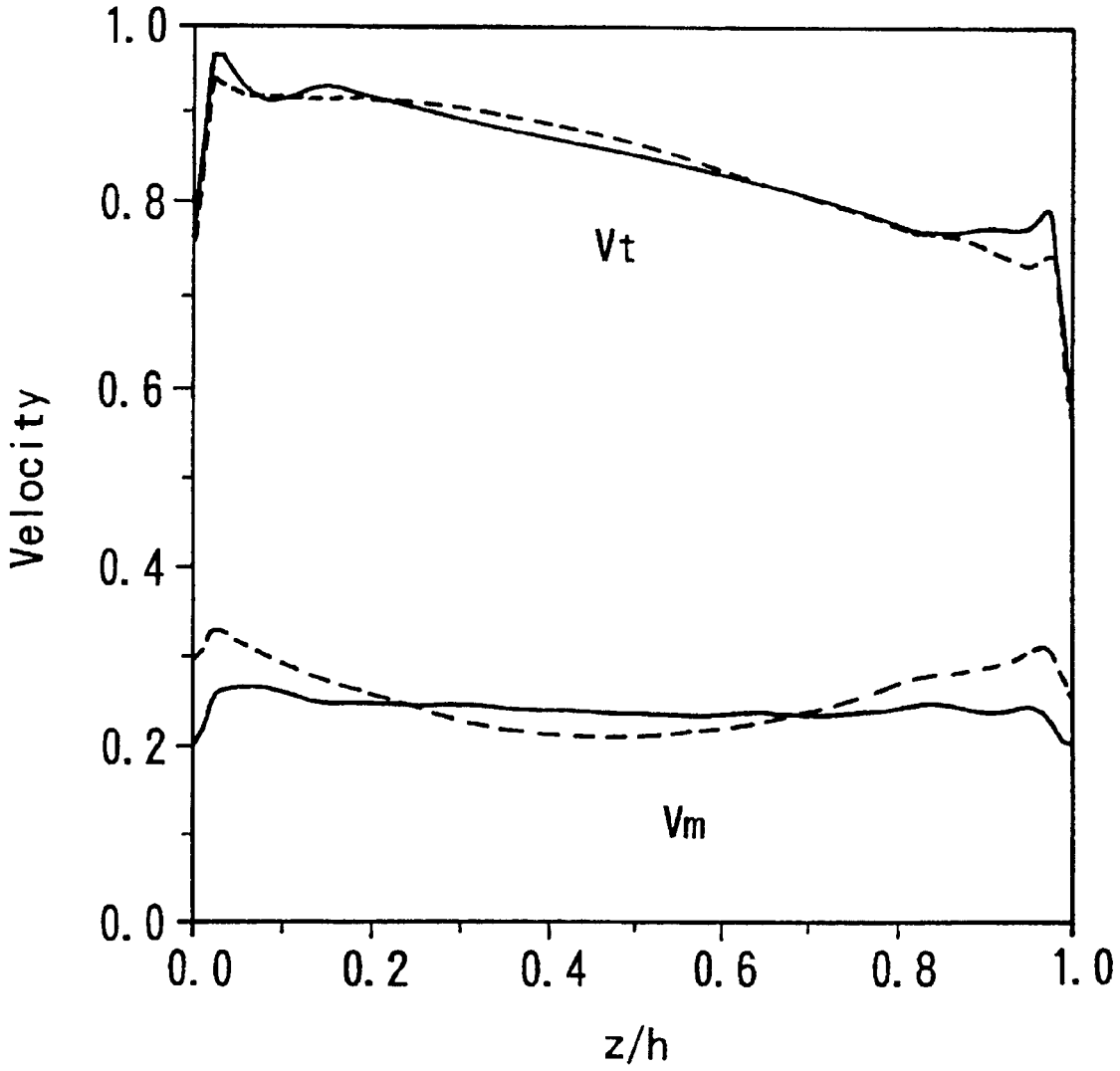
FIG. 19 is a graph showing flow velocity distributions of an ordinary blade and those of a curved blade for comparison.

Further, with the conventional secondary flow control nozzle shown in FIGS. 15 through 18, the distribution of velocities at the nozzle outlet varies greatly as shown in FIG. 19.

Figure 13:
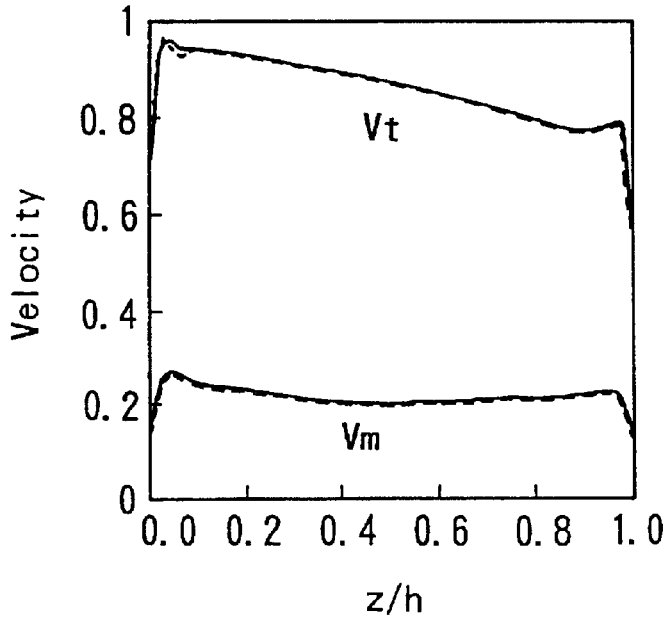
FIG. 13 is a graph showing a distribution of velocities at a blade outlet.

With the nozzle blade according to the present invention, however, the distribution of velocities at the blade outlet (circumferential velocities Vt and meridional velocities Vm, which are expressed as a dimensionless ratio with respect to the absolute velocity $V=(Vt^2+Vm^2)^{0.5}$) remains substantially the same as that of the ordinary nozzle blade, as shown in FIG. 13.

Consequently, even if only the nozzle blades in a conventional turbine stage are replaced with the nozzle blades according to the present invention, the turbine nozzle does not adversely affect the rotor blades positioned downstream of the turbine stage.

As described above, the turbine nozzle according to the present invention is capable of suppressing a secondary flow at the ends of nozzle blades for thereby reducing a loss caused by the secondary flow. Further, the turbine nozzle according to the present invention provides a velocity distribution at the nozzle outlet which is the same as that of the ordinary nozzle blades, and thus does not adversely affect the rotor blades positioned downstream of the turbine nozzle.

Although a certain preferred embodiment of the present invention has been shown and described in detail, it should be understood that various changes and modifications may be made therein without departing from the scope of the appended claims.

INDUSTRIAL APPLICABILITY

The present invention is suitable for a turbine which is used for driving various machines such as an electric generator in a power generating plant.

What is claimed is:

1. A turbine nozzle comprising:

an array of nozzle blades disposed circumferentially in an annular passage defined between a hub end wall of an inner ring and a tip end wall of an outer ring and fixed to said hub and tip end walls; and a flow passage defined between a pressure surface and a suction surface of adjacent ones of said nozzle blades, a cross section of said flow passage within a predetermined region from a leading edge of the nozzle blade in the meridional direction comprising a curved line on each of said pressure surface and said suction surface in a predetermined range of the blade height inwardly from said hub and tip end walls and a substantially straight line on each of said pressure surface and said suction surface in another range, wherein said predetermined range comprises a range corresponding to 20 to 40% of said blade height inwardly from said hub and tip end walls.

2. A turbine nozzle comprising:

an array of nozzle blades disposed circumferentially in an annular passage defined between a hub end wall of an inner ring and a tip end wall of an outer ring and fixed to said hub and tip end walls; and a flow passage defined between a pressure surface and a suction surface of adjacent ones of said nozzle blades, a cross section of said flow passage within a predetermined region from a leading edge of the nozzle blade in the meridional direction comprising a curved line on each of said pressure surface and said suction surface in a predetermined range of the blade height inwardly from said hub and tip end walls and a substantially straight line on each of said pressure surface and said suction surface in another range, wherein said predetermined region comprises a region from said leading edge of said nozzle blade to a position of at least 30% of the blade width in the meridional direction.

3. A turbine nozzle comprising:

an array of nozzle blades disposed circumferentially in an annular passage defined between a hub end wall of an inner ring and a tip end wall of an outer ring and fixed to said hub and tip end walls; and a flow passage defined between a pressure surface and a suction surface of adjacent ones of said nozzle blades, a cross section of said flow passage within a predetermined region from a leading edge of the nozzle blade in the meridional direction comprising a curved line on each of said pressure surface and said suction surface in a predetermined range of the blade height inwardly from said hub and tip end walls and a substantially straight line on each of said pressure surface and said suction surface in another range, wherein said cross section of said flow passage within a range from said leading edge of said nozzle blade to a position of at least 30% of the blade width in the meridional direction is defined by a line on said pressure surface and a line on said suction surface, each of said lines comprising a substantially straight line in a central portion which does not include a range corresponding to 20 to 40% of said blade height inwardly from said hub and tip end walls.

4. A turbine nozzle according to claim 3, wherein the distance from an intersection between the line on the pressure surface or the suction surface and said hub end wall to an intersection between an extension of said substantially straight line and said hub end wall, and the distance from an intersection between the line on the pressure surface or the suction surface and said tip end wall to an intersection between an extension of said substantially straight line and said tip end wall have a maximum value at the leading edge of said nozzle blade.

5. A turbine nozzle according to claim 4, wherein said maximum value ranges from 5 to 15% of said blade height.

6. A turbine nozzle according to claim 4, wherein said distances at said leading edge of said nozzle blade are in the range of 5 to 15% of said blade height, and are at least 4% of said blade height within a region from said leading edge of said nozzle blade to a position of at least 30% of the blade width in the meridional direction.

* * * * *